United States Patent [19]

Dicke

[11] Patent Number: 4,475,317

[45] Date of Patent: Oct. 9, 1984

[54] PAPER RETAINER FOR A SANDING DEVICE

[75] Inventor: William C. Dicke, Easley, S.C.

[73] Assignee: The Singer Company, Stamford, Conn.

[21] Appl. No.: 555,779

[22] Filed: Nov. 28, 1983

[51] Int. Cl.[3] ..... B24B 23/00; B24D 15/00

[52] U.S. Cl. ..... 51/170 TL; 51/170 MT; 51/382; 51/391

[58] Field of Search ..... 51/170 MT, 170 TL, 170 R, 51/382–386, 391–393, 175

[56] References Cited

U.S. PATENT DOCUMENTS

| | | | |
|---|---|---|---|
| 672,408 | 4/1901 | McAfee . | |
| 1,049,479 | 1/1913 | Hedges . | |
| 1,320,299 | 10/1919 | Wilson . | |
| 1,522,459 | 1/1925 | Jackowitz . | |
| 2,302,424 | 11/1942 | Delnostro . | |
| 2,334,173 | 11/1943 | Champayne . | |
| 2,475,476 | 7/1949 | Champayne . | |
| 2,683,337 | 7/1954 | Scace . | |
| 2,848,850 | 8/1958 | Metoff . | |
| 3,014,316 | 12/1961 | Barnhart . | |
| 3,136,099 | 6/1964 | Tully et al. . | |
| 3,418,761 | 12/1968 | Sheps . | |
| 3,822,518 | 7/1974 | Sjostrand | 51/386 |
| 3,973,362 | 8/1976 | Groshans | 51/386 |
| 4,030,254 | 6/1977 | Marcantonio | 51/386 |
| 4,077,165 | 3/1978 | Hutchins | 51/386 |
| 4,216,631 | 8/1980 | Ryer | 51/170 MT |

*Primary Examiner*—Roscoe V. Parker

*Attorney, Agent, or Firm*—Edward P. Schmidt; Robert E. Smith; Edward L. Bell

[57] ABSTRACT

An in-line sander for hand held operation and having a housing in which a rotating electric motor drives a drive shaft to rotate on a first axis, with a second axis of the drive shaft canted to the first axis and supporting a bearing thereon. A wobble housing is supported on the bearing to orbit therewith, the wobble housing having an arm extending to a platen support and extensibly and pivotably connected to a portion thereof. This orbiting of the wobble housing influences motion of the platen support in accordance with the angle of the cone described by the second axis of the drive shaft. The platen support is made of a resilient material and carried by the housing on legs extending to a base portion, which legs have a low moment of inertia in the direction of in-line sanding, and a high moment of inertia normal to the direction of in-line sanding, so as to be disposed to motion in the in-line sanding path only. A platen is attached to the platen support by a key and key slot, one on each, which permits assembly when mis-aligned and retains the platen to the platen support when rotated to an aligned position. Resilient paper clamps are provided which cooperate with grooves in the upper surfaces of posts on the platen, to retain sand paper to the platen.

3 Claims, 5 Drawing Figures

PAPER RETAINER FOR A SANDING DEVICE

BACKGROUND OF THE INVENTION

This invention relates to a surface treating machine; more particularly, to retainers for hand or power driven devices or tools adapted to be manipulated over a surface to be treated by sanding.

In surface treating machines, of which perhaps the most important is a sanding machine, the portable electric sander has become very popular in recent years. As a result of the "Do-It-Yourself" trend, there has been a tremendous increase in demand for portable electric sanders, and there have been extensively sold on the market several types of sanders, among which are the purely vibratory sander, the rotary disc type sander, the belt type sander, the orbital sander, the reciprocating sander, and others.

A surface treating machine such as an electric sander requires simple and readily actuatable means for releasing and securing the sandpaper to the machine. This is so because it frequently becomes necessary to change the sandpaper which becomes charged with the removed material and must be replaced to reinstate sanding effectivness.

The prior art abounds with clamping devices, including several over center locking devices. However, many of these prior art devices are characterized by expensive construction, requiring a multiplicity of parts or excessive material; and some require considerable operator care to assure adequate sandpaper tautness which insure uniformity of sanding.

What is required is a simple, economical and effective device, which is readily engageable and disengageable, and which aides in the tautening of sandpaper as it engaged.

SUMMARY OF THE INVENTION

The above requirements are attained in a sanding device having a rectangular platen with a supporting side for supporting a strip of sandpaper. The platen includes a post extending upwardly therefrom on the side opposite the supporting side, adjacent a pair of opposite ends thereof. The posts have a groove extending substantially vertically downward from the top thereof substantially parallel to the adjacent end thereof. The grooves are defined by an outer wall adjacent the end and an inner wall, with the outer wall having a height less than the inner wall. The posts are further formed with a pair of apertures extending inwardly toward each other from opposite sides of the posts and parallel to the groove. A resilient wire is provided having its terminal ends carried in the apertures for pivotal motion of the wire. Radial portions of the wire extend transversely from the terminal ends, which radial portions execute 270° outward circular curves that terminate into a central straight portion spaced from the apertures a distance sufficient to create a slight interference with the outer wall when the resilient wire is pivoted thereover. Thus, as the resilient wire is pivoted about the terminal ends carried in the apertures in the posts, the central straight portion thereof will yield, resiliently, to the outer wall to enable seating of the central straight portion in the groove between the inner and outer wall, or to permit release of the central straight portion from the groove. As the central straight portion is moved from the outer wall to the groove, a strip of sandpaper having an end interposed between the outer wall and the central straight portion will be drawn by motion of the central straight portion towards the groove to effect a tautening of the strip of sandpaper. Removal of the central straight portion from the groove might be implemented by grasping the 270° circular curve portions of the resilient wire and drawing outwardly out of the groove and over the outer wall thereof.

BRIEF DESCRIPTION OF THE DRAWINGS

The invention is illustrated by way of example in the accompanying drawings wherein:

Referring now to FIG. 1, there is shown a side elevation of an in-line sander 10 in which a sanding platen 12 carried thereby reciprocates laterally as viewed in FIG. 1. The in-line sander 10 may be connected by means of electrical leads 14, only a portion of which are shown, to a source of electric power so as to influence endwise reciprocation of the platen 12 when initiated by actuation of the switch actuator 16. The in-line sander 10 may include a housing 18 of clam shell construction in which a support half 20 (see FIG. 2) supports the various components therein and a cover half 22 might be attached thereto by screws 23.

Referring to FIG. 2, the in line sander 10 is shown with the cover housing 22 broken away therefrom in order to show the internal details of construction. Thus, it is shown that the support housing 20, which is preferably molded of a synthetic resin material, is fashioned with ribs to support therein a motor 25, including a stator 24, and rotor 26 having a shaft 27 carried in bearings 28, 30, also supported by ribs formed as part of the cover housing. The shaft 27 also supports thereon a fan 32 for directing cooling air from vents (not shown) supplied in the cover housing 22 and support housing 20 so as to provide for motor cooling. Also supported on the shaft 27 of the rotor 26 is commutator 34 which is engaged by brushes 36 supported in brush tubes 37 themselves carried by ribs molded as part of the cover housing 22 and support housing 20. Switch actuator 16 is seen to extend to switch 17 for selective actuation thereof.

Figure 1:
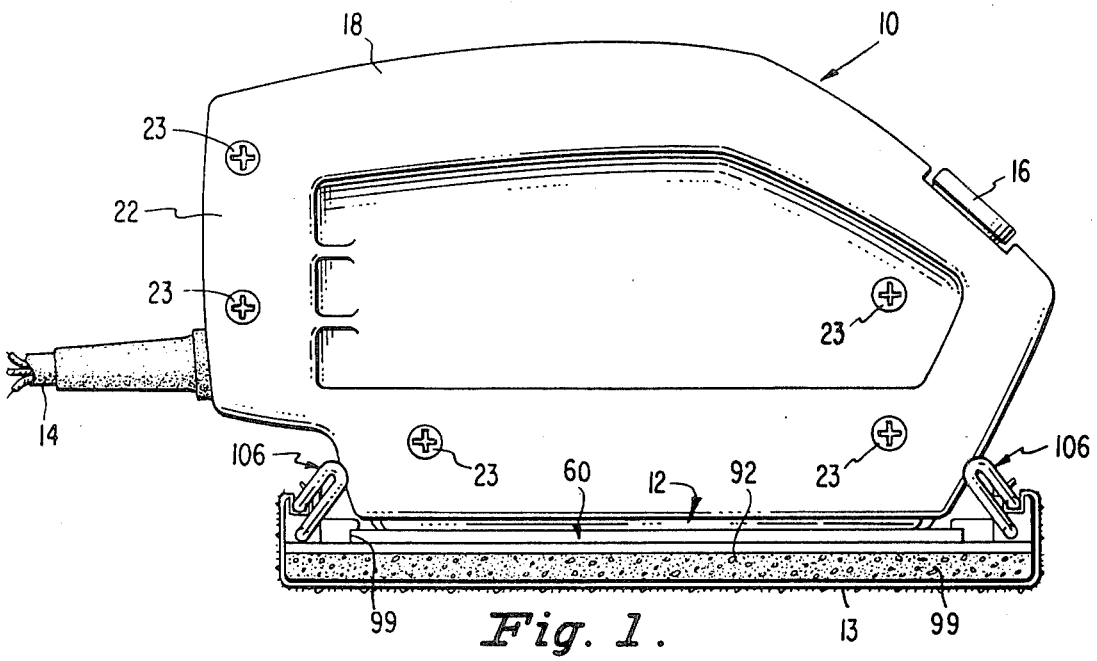
FIG. 1 is a side elevation of the in line sander of the invention.

Beyond the ball bearing 30, the rotor shaft 27 supports thereon pinion 38. Pinion 38 is in mesh with gear 40 carried by a wobble drive shaft 42, itself, supported on bearings 44, 46 carried on ribs of the support housing 20 and cover housing 22. Wobble drive shaft 42 is formed with an end 43 thereof having its axis at an angle or canted to the main portion of the drive shaft 42. Thus, as the drive shaft 42 is rotated, the axis of the end 43 thereof would describe the surface of a cone.

A wobble bearing 50 implemented by a ball bearing is supported on the end 43 of the drive shaft 42. A wobble bearing housing 52 shown partly in section, is attached to the outer periphery of the wobble bearing 50, typically by retaining ring 53. The wobble bearing housing 52 is formed with an arm 54 extending therefrom, which arm terminates in a pivot ball 56.

Figure 2:
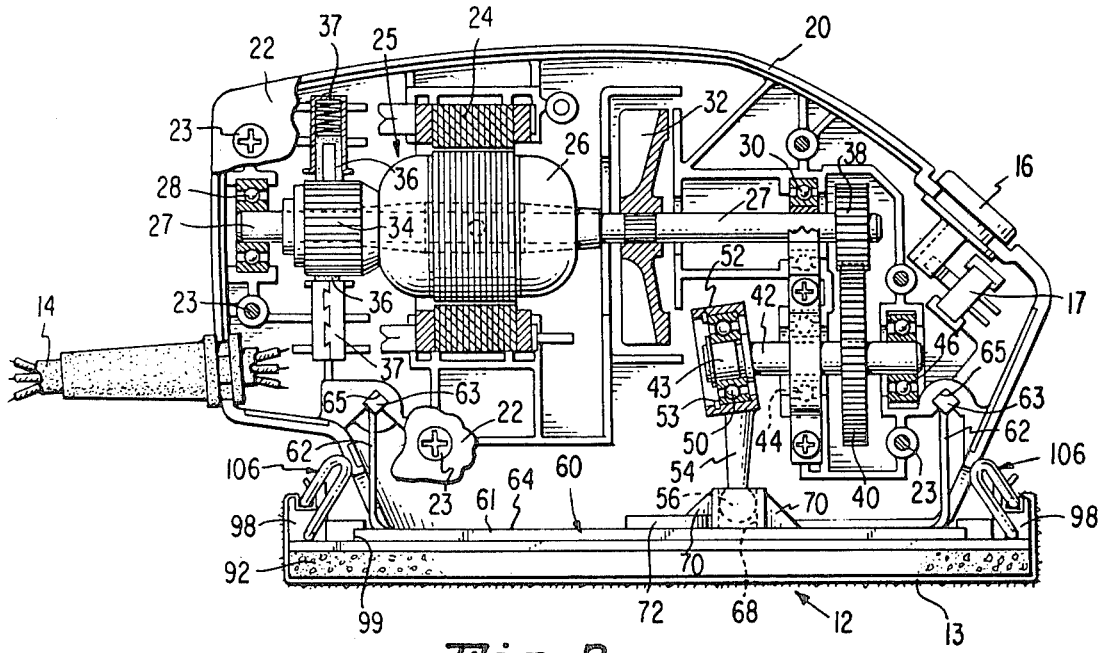
FIG. 2 is a view similar to FIG. 1 with a portion of a clam shell cover broken away and partially in section to show inner details thereof.
Figure 3:
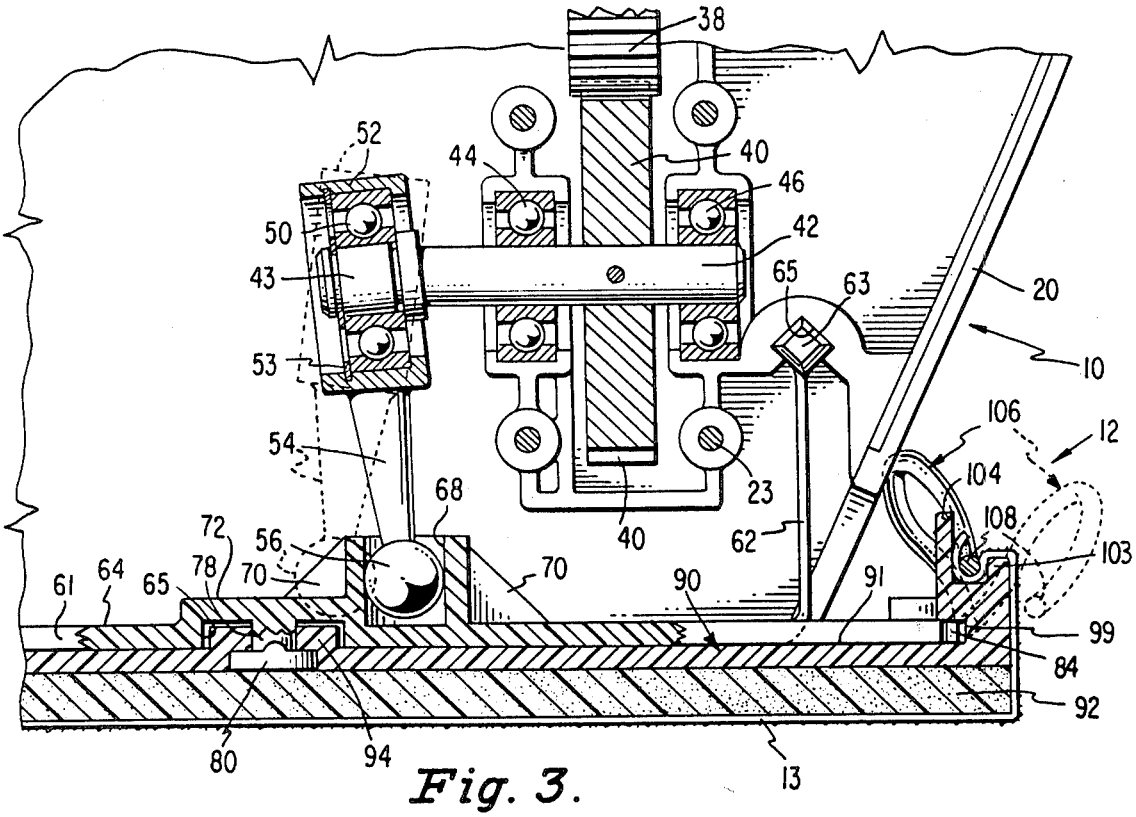
FIG. 3 is an enlarged detailed view of the drive for the platen support.
Figure 4:
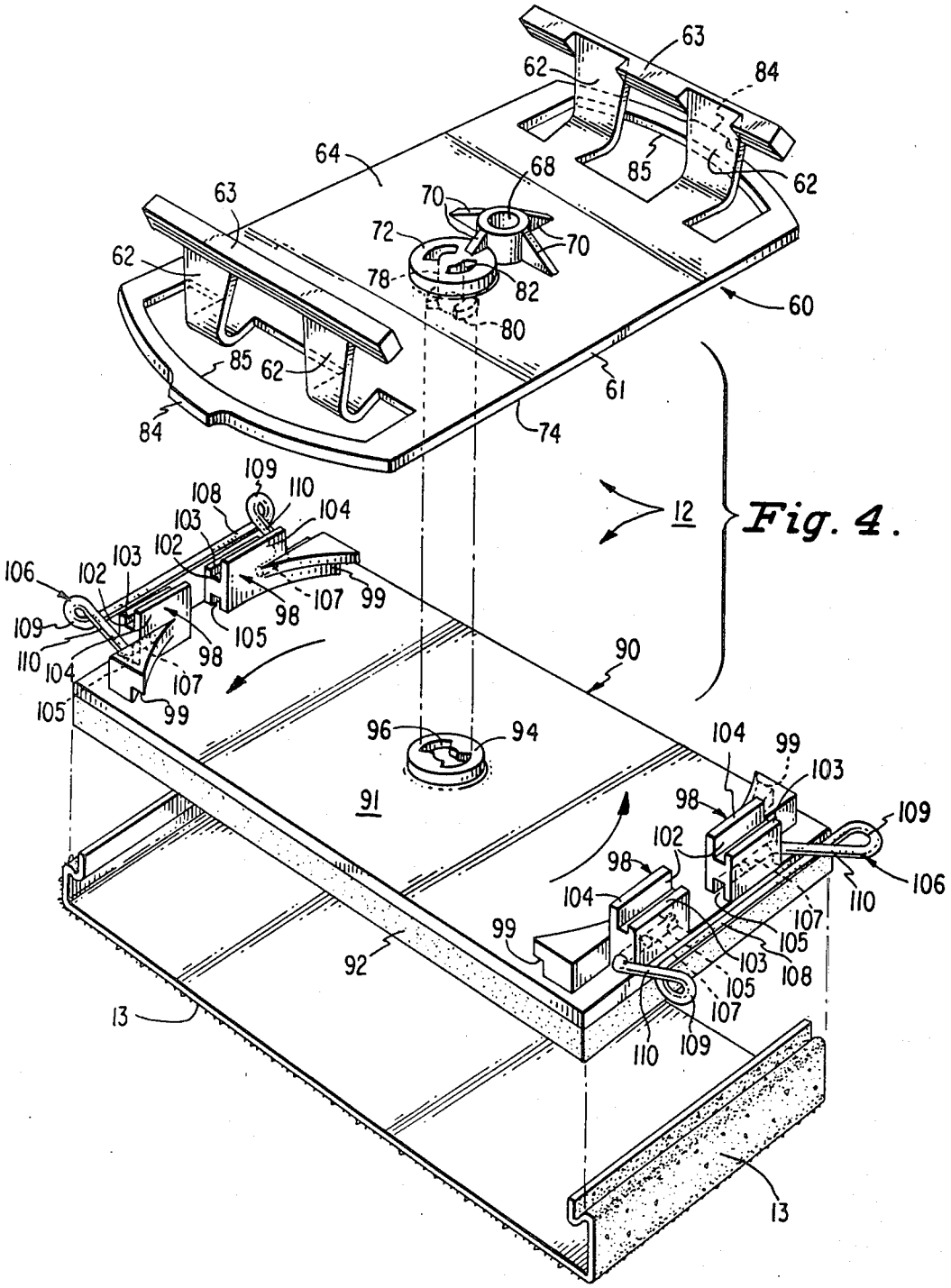
FIG. 4 is a disassembled perspective view of the platen support and platen to show the manner of disassembly and assembly thereof; and, FIG. 5 is a detached perspective view of key and key slot of the platen support and platen to provide a greater understanding of the assembly thereof.

Also visible in FIG. 2, is a platen support 60 which may also be formed of a molded synthetic resin material or other resilient material. The platen support 60, also visible in FIGS. 3 and 4, is fashioned with a base portion 61, from which base a pair of legs 62 extend upwardly from either end approximately normally thereto. The upper end of each pair of legs 62 are joined by a bar 63 of square cross section having a diagonal thereof as an extension to the legs. The bars 63 are received in corresponding cavities 65 formed as part of the support housing 20 and cover housing 22.

Extending upwardly from the base portion 61 of the platen support 60, is a well 68 of circular hollow interior. Ribs 70 extend from the upper edge of the well 68 to the base portion 61 for the purpose of increasing the rigidity of the well. The hollow internal diameter of the well 68 is of a dimension to slidably receive the pivot ball 56 on the end of the arm 54 of the wobble bearing housing 52 (see FIG. 3). Thus, it can be appreciated, that as the drive shaft 42 is urged into rotation by the actuation of the motor 25, the attachment of the wobble bearing 50 to the canted end 43 of the drive shaft will cause the wobble bearing to orbit around the axis of the drive shaft 42 so that the pivot ball 56 at the extremity of the arm 54 attached to the wobble bearing housing 52, will be constrained by the well 68 in platen support 60 to which it is attached to move in a back and forth path, with any lateral oscillations of the housing 52 being accommodated by a vertical motion within the well 68. Linearity of motion of the platen support 60 is as a result of the limberness or flexibility of the legs 62 in the direction of the length of the base 61, or longitudinally, implemented by minimum thickness; and of the rigidity of each spaced apart pair of legs on either end of the base to motion in a direction normal to the length of the base, implemented by width of each leg and wide spearation therebetween. In other words, the moment of inertia of the legs 62 is extremely low in the long dimension of the base 61, and the moment of inertia of a pair of legs 62 is extremely high in a direction transverse to the long dimension of the base. The moment of inertia in the transverse direction is enhanced by the maximum separation possible between legs in each pair of legs on the base 61. The result is that essentially no transverse motion will take place, while longitudinal motion is quite readily accommodated. The legs 62 may be fashioned of uniform thickness, but with a greater width adjacent bar 63 and tapering to the base 61 to improve its resistance to hand pressure on the housing pressing the platen 12 and sand paper 13 carried thereby against a work material such as an article of furniture, providing improved capability as a column without affecting its flexibility in the longitudinal direction or its lateral rigidity. In place of a pair of legs 62 on each end of the platen support 60, it is apparent that a single leg of much greater width but the same thickness could be used having much the same characteristics.

Immediately adjacent the well 68 on the platen support 60 there is located a platform 72 which extends above the top 64 of the base 61. Visible in FIGS. 3, 4 and 5, the platform 72 on the top 64 of the base 61 is fashioned with a circular counterbore 76 extending from the bottom 74 of the base (see FIG. 3) coaxially with the circular platform 72 and having an inner flat face at about the level of the top 64 of the base. The circular counterbore 76 is formed with a supporting pin 78 extending in depth to approximately the bottom surface 74 of the base portion 61 and terminating therein in a bow tie shaped key 80. Apertures 82 may be molded as part of the circular platform 72 in order to provide core access for molding of the bow tie key 80. Additionally to the above, the base 61 of the platen support 60 is formed with tab extensions 84 to the base beyond the legs 62 thereof, for a purpose which will be explained below.

Figure 5:
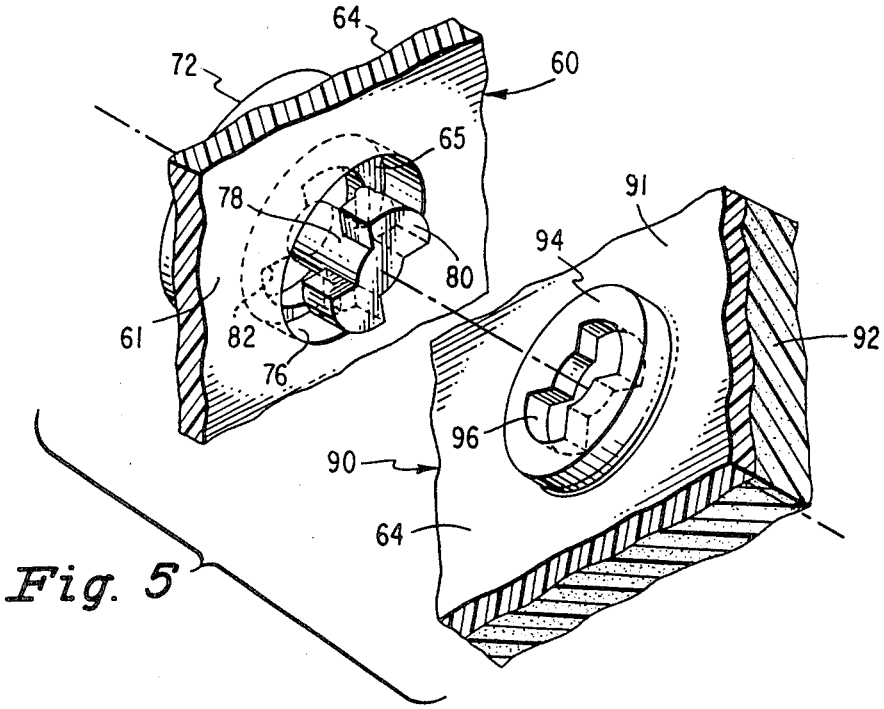

Also referring to FIGS. 3, 4 and 5, there is visible a platen 90 which is positioned immediately adjacent the platen support 60. The platen 90 includes a rubber pad 92 which is affixed to the bottom thereof to provide a resilient surface for the sand paper 13 which is positioned abutting this platen. The top surface 91 of the platen 90 and the bottom 74 of base 61 of platen support 60 are mating surfaces which are contiguous when these parts are assembled. The top surface 91 is formed with a raised circular land 94 of a diameter to be accommodated in the circular counterbore 76 of the platen support 60. The raised circular land 94 is fashioned with a key slot 96 to accommodate the bow tie key 80 of the platen support 60, with the key slot extending for a thickness something less than the length of the pin 78 and the raised circular land being counterbored beyond that point to a diameter to freely accommodate rotation of the bow tie key 80. As shown in FIG. 4, the bow tie key 80 extends transversely across the platen support 60, whereas the key slot 96 in the platen 90 extends in the lengthwise direction of the platen. Accordingly, the bow tie key 80 may be fitted into the key slot 96 when the platen support 60 and platen 90 have their maximum lengthwise direction at 90° to one another; and with the key extending through the key slot, the platen support may be rotated so that the bow tie key may not be withdrawn through the key slot 96.

The platen 90 is further formed with a pair of posts 98 on each end thereof, which posts are grooved 99 adjacent the top surface 91 of the platen on a radius swung from the center of the raised circular land 94. The grooves 99 of the posts 98 are of a sufficient height to accommodate the tab extensions 84 of the base 61 of the platen surface 60, but, ideally, the length across the tab extensions 84 of the platen support 60 exceeds the dimensions between the grooves 99 of the posts 98 on either end of the platen 90 sufficiently to cause a slight interference when the raised circular land 94 of the platen is inserted into the counterbore 76 of the platen support and the platen is rotated to bring the tab extensions into the grooves. The posts 98 on either end of the platen 90 are spaced apart a sufficient amount to accommodate the width of the tab extensions 84 of the platen support 60, so that as the platen support is rotated to place the tab extensions between the posts, the platen support will snap into a position aligned with the platen in a detent action. A slot 85 extends laterally across the base 61 behind each tab extension 84 to permit deflection of each tab extension are mounted sufficient to allow the tab extensions to enter the grooves 99. This deflection is enhanced if the platen support 60 is fashioned from a synthetic resin material such as nylon.

The posts 98 are further fashioned with vertical grooves 102 extending across the posts from the top thereof. The outer walls 103 defining the vertical grooves 102 are shorter than the inner walls 104 thereof. The pair of posts 98 on either end of the platen 90 are formed with apertures 105 extending transversely of the platen parallel to the ends thereof. Thus, apertures 105 on each end of the platen 90 are axially aligned, and are spaced adjacent the end of the platen and parallel thereto. A formed wire 106 is arranged with ends 107 extending into the apertures 105 on the outside of posts 98 on each end of platen 90. The formed wire 106 is then bent 90° to pivot adjacent the posts 98 beyond the outer wall 103 thereof. A central straight portion 108 of the formed wire 106 is spaced from the ends 107, and parallel thereto, at a distance therefrom which would bring it into engagement with the outer wall 103 adjacent the top thereof on pivotal motion of the formed wire. A resilient connection 109 between the central straight portion 108 and radial portions 110, allows the central straight portion to deflect outwardly of the ends 107 and over the top of the outer wall 103 and into vertical groove 102. As shown in the drawings, the resilient connection 109 is implemented by forming the radial portions 110 in 270° of a circle large enough for a given wire diameter to provide the desired resiliency, terminating in the central straight portion 108. Thus, the paper clamp formed wire 106 may be rotated outwardly of the post 98 atop the sand paper 13, from which position it may be rotated over the outer wall 103 of the post with the central straight portion 108 of the formed wire 106 deflecting the end of sand paper 13 into the vertical groove 102 in the pair of posts 98 on one end of the platen 90. The vertical groove 102 is of such a width to accommodate the diameter of wire 106 used, and thickness of sand paper 13, as is shown in FIG. 3. The paper clamp thus implemented deflects the sand paper 13 into the vertical grooves 102, effecting a tautening of the sand paper during the process of deflecting over the outer wall 103 and obtaining a snap of the central straight portion 108 thereof into the groove which retains the sand paper until released by a deliberate operator outward manipulation of the resilient connections 109 to remove the central straight portion 108 from the groove 102.

By way of example, operation of the motor 25 at a no load speed of 23000 RPM might reciprocate the platen 90 and the sand paper 13 carried thereby at 8000 strokes per minute, with the proper speed reduction gearing. For this finishing sander, in which the sanding operation takes place in the same direction as the wood grain, a stroke might entail a $\frac{1}{8}''$ out and return motion, for example.

The foregoing detailed description is given for clearness of understanding only, and no unnecessary limitations should be understood therefrom, for some modifications will be obvious to those skilled in the art.

I claim:

1. In a sanding device having a rectangular platen for supporting a strip of sandpaper, a paper retaining system comprising a post extending upwardly from said platen adjacent each of two opposite ends thereof, said posts having a groove extending substantially vertically downwardly from the top thereof substantially parallel to said adjacent end thereof, said grooves forming outer walls adjacent said ends and inner walls, with said outer walls having a height above said groove less than said inner walls, said posts being further formed with a pair of apertures extending inwardly towards each other from opposite sides of said posts parallel to said grooves adjacent said rectangular bed; and a resilient wire having terminal ends carried by said aperture for pivotal motion thereof, a means associated with a central portion of said wire for resiliently yielding to said outer wall on being carried thereto by pivotal motion of said wire, said yielding means being retained in said groove with an end of said strip of sand paper and being prevented from yielding to said inner walls because of the increased height thereof.

2. In a sanding device as claimed in claim 1 wherein said yielding means further comprises a central straight portion of said wire spaced from said apertures a distance to create a slight interference with said outer wall on pivotal motion of said wire, radial portions of said wire extending transversely from said terminal ends thereof carried in said apertures, and resilient connections between said radial portions and said central straight portion, implemented by a 270° circular curve of said radial portion beyond and away from said central straight portion and thence into said central straight portion.

3. In a sanding device as claimed in claim 2, wherein said central straight portion of said resilient wire on said pivotal motion thereof over said outer wall towards said inner wall, operates to draw said strip of sandpaper over said outer wall to tauten said strip due to the friction between said strip and said central straight portion.

* * * * *